US010274296B2

(12) United States Patent
Tedder et al.

(10) Patent No.: US 10,274,296 B2
(45) Date of Patent: Apr. 30, 2019

(54) MODULAR CARRIER

(71) Applicant: Tedder Industries, LLC, Hayden, ID (US)

(72) Inventors: Thomas Tedder, Hayden, ID (US); Drew Stephens, Coeur d'Alene, ID (US); Silas Van Natter, Post Falls, ID (US); Taylor Vold, Valleyford, WA (US); Tim Treto, Mead, WA (US); Christopher Weber, Coeur d'Alene, ID (US)

(73) Assignee: TEDDER INDUSTRIES, LLC, Post Falls, ID (US)

( * ) Notice: Subject to any disclaimer, the term of this patent is extended or adjusted under 35 U.S.C. 154(b) by 123 days.

(21) Appl. No.: 15/277,961

(22) Filed: Sep. 27, 2016

(65) Prior Publication Data

US 2018/0087884 A1 Mar. 29, 2018

(51) Int. Cl.
*F42B 39/02* (2006.01)

(52) U.S. Cl.
CPC ..... *F42B 39/02* (2013.01)

(58) Field of Classification Search
CPC ..... A45F 5/022; F41C 33/048
USPC ..... 224/587, 912
See application file for complete search history.

(56) References Cited

U.S. PATENT DOCUMENTS 5,174,482 A * 12/1992 Rogers ..... F42B 39/02 221/185
5,261,583 A * 11/1993 Long ..... A45F 5/02 206/305
5,303,860 A * 4/1994 Serafini, Jr. ..... F41C 33/0218 220/324
5,421,497 A * 6/1995 Gilmore ..... A45F 5/00 224/192
5,931,358 A * 8/1999 Rogers ..... F41C 33/02 224/243
6,000,589 A * 12/1999 Burdine ..... F41A 9/65 221/185
6,264,079 B1 * 7/2001 Skaggs ..... F41C 33/0236 224/193
6,547,111 B2 * 4/2003 French ..... F41C 33/0227 224/244
6,604,657 B2 * 8/2003 Yirmiyahu ..... F41C 33/0227 224/243
7,258,259 B1 * 8/2007 Owens ..... A45F 5/02 224/192
7,389,899 B2 * 6/2008 Johnson ..... A45F 5/02 224/675
7,461,765 B2 * 12/2008 French ..... F41C 33/0227 224/238

(Continued)

*Primary Examiner* — Brian D Nash

(74) *Attorney, Agent, or Firm* — Timberline Patent Law Group

(57) ABSTRACT

Representative implementations of devices and techniques provide a modular carrier for a tactical implement or for an accessory to a weapon, tool, or other implement, for example. The modular carrier comprises first and second shell components to at least partially encase the accessory. The first and second shell components are adjustably attached using at least one attachment member on each of the first and second shell components, to form an enclosure. At least one adjustable retention component may be used with the attachment members to adjust the retention of the enclosure.

27 Claims, 10 Drawing Sheets

(56) References Cited

U.S. PATENT DOCUMENTS

| | | | | |
|---|---|---|---|---|
| 7,841,497 | B1 * | 11/2010 | Gregory | F41C 33/045 224/243 |
| 8,474,670 | B1 * | 7/2013 | Gregory | F41C 33/0263 224/243 |
| 8,672,201 | B2 * | 3/2014 | Craighead | F41C 33/041 224/587 |
| 8,887,972 | B2 * | 11/2014 | Solomon | A45F 5/02 224/245 |
| 8,973,799 | B2 * | 3/2015 | Ruiz, III | F41C 33/048 224/192 |
| 9,696,113 | B2 * | 7/2017 | Tedder | F41C 33/0263 |
| 9,702,659 | B2 * | 7/2017 | Bowman | F41C 33/041 |
| 9,958,233 | B2 * | 5/2018 | Considine | F41C 33/048 |
| 2002/0047029 | A1 * | 4/2002 | Liao | F41C 33/0209 224/244 |
| 2005/0127121 | A1 * | 6/2005 | Wells | F41C 33/0209 224/193 |
| 2005/0184115 | A1 * | 8/2005 | Wells | A45F 5/02 224/193 |
| 2015/0034684 | A1 * | 2/2015 | Tedder | A45F 5/00 224/242 |
| 2015/0247701 | A1 * | 9/2015 | Faifer | F41C 33/0209 224/244 |
| 2016/0066680 | A1 * | 3/2016 | Hazeltine | A45F 5/021 224/676 |
| 2016/0216065 | A1 * | 7/2016 | Tedder | F41C 33/0263 |

* cited by examiner

MODULAR CARRIER

BACKGROUND

Implements, such as tools, weapons, and the like, may be encased in a carrier for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished.

Accessories for the implement may also be encased in a carrier for protection of the accessory and/or the user, while providing ready access to the accessory. For example, a carrier may be worn near to a carrier or in another convenient location, for ready access to an accessory (such as an ammunition magazine, for example) to be used with the implement as desired.

In the case of a magazine for firearms ammunition, the carrier should reasonably protect the magazine and the user, and should be convenient to the user for ready use. Accordingly, the carrier should retain the magazine until it is to be used, but allow the user to withdraw the magazine without undue effort or difficulty. The carrier should be rigid and stable enough to allow a magazine to be repeatedly withdrawn and replaced, usually with the same hand. Further, a carrier for any purpose should also be versatile enough to be comfortably carried by the user in various configurations or attached to an object for storage or concealed use when desired.

In some cases, a user may own more than one variety of firearm or other implement. Generally, the accessories (e.g., magazines, etc.) for the different firearms or other implements have their own unique size and shape. Fabric and other less-rigid pouches are often used more or less universally to accommodate the variety of sizes and shapes of accessories with a single carrier. However, fabric and some other less-rigid pouches can have a limited durability and can be more limited in carry or attachment configuration options.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Introduction

Figure 1:
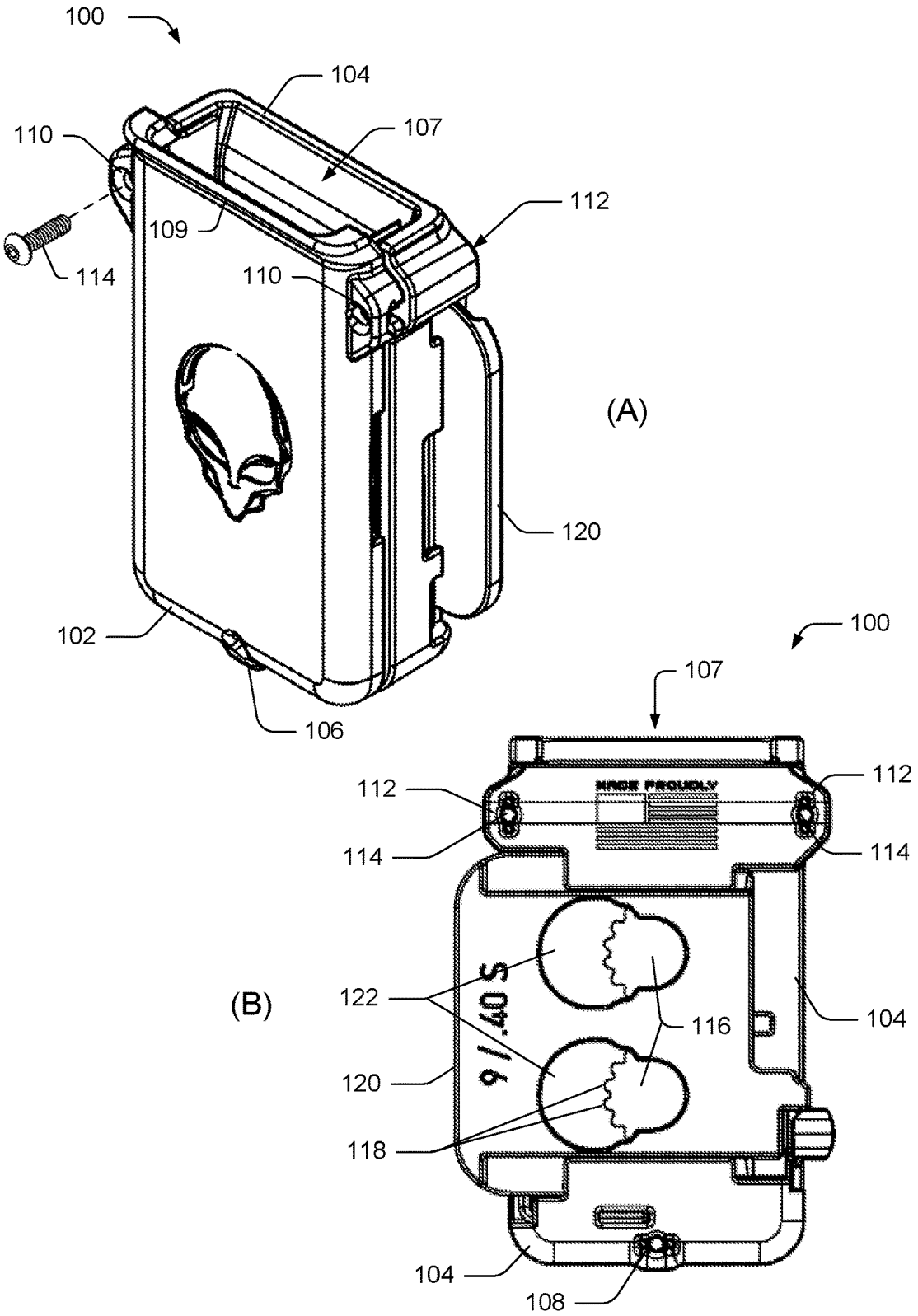
FIG. 1 includes two views, a front perspective view (at A), and a back view (at B), of an example modular carrier assembly, according to an embodiment.

Representative implementations of devices and techniques provide a modular carrier for a tactical implement or for an accessory to a weapon, tool, or other implement, for example. The modular carrier comprises first and second shell components to at least partially encase the accessory. The first and second shell components are pivotally and/or adjustably attached using an attachment member on each of the first and second shell components, to form an enclosure.

In an implementation, an adjustable retention component is arranged to mechanically engage first and second retention members of the first and second shell components to determine an interior volume of the enclosure and a retention force on the tactical implement or accessory. In some embodiments, the first and second shell components include multiple retention members, each of which may be engaged by a retention component (which may also be adjustable).

In one embodiment, the modular carrier includes a mounting assembly that may be used to mount interchangeable clips or other mounting attachments for the carrier. For example, a clip may be interchanged and/or adjusted to various positions or configurations by the user. In various implementations, the mounting assembly includes one or more recesses arranged on a surface of the second shell component to provide one or more clip mounting locations. Various interchangeable clips include a lug arranged to interface with the recesses. For example, the clip can have a different mounting configuration based on which of the recesses the lug is interfaced with.

In some implementations, the head of the lug has a featured shape to match the shape of the recesses. When the head of the lug is inserted into a recess, the head has a secure fit within the recess, causing the clip to have one of a plurality of discrete rotational orientations relative to the enclosure. The secure fit prevents the clip from rotating further relative to the enclosure. This arrangement provides a plurality of mounting orientations for the carrier based on the rotational orientation of the clip.

In an embodiment, the mounting assembly includes a locking plate slideably coupled to the second shell component and including one or more openings to correspond to the one or more recesses on the surface of the second shell component. The locking plate is arranged to prevent the head of the lug from being inserted into the one or more recesses or from being removed from the one or more recesses when the locking plate is in a first position and to allow the head of the lug to be inserted into the one or more recesses or removed from the one or more recesses when the locking plate is in a second position.

In one example, the one or more openings of the locking plate have a keyhole shape arranged to allow the head of the lug to pass through the locking plate when the locking plate is in the second position and to prevent the head of the lug from passing through the locking plate when the locking plate is in the first position. In an embodiment, a portion of the locking plate is arranged to overlay and trap a portion of the head of the lug when the head of the lug is inserted into the one or more recesses and the locking plate is in the first position.

In one embodiment, the modular carrier includes a storage compartment, which may be concealed by the locking plate. Moving the locking plate can reveal the compartment and provide access to the compartment. In one example, a retention adjustment tool is stored in the storage compartment, and is accessed by moving the locking plate.

In an implementation, the modular carrier includes a removable protective backer. The backer may be attached to the first shell component while a clip is attached to the second shell component, for example, and provide a comfort barrier between the enclosure and the body of a user when the enclosure is worn by the user in an inside the waistband (IWB) configuration.

In one example, the modular carrier components may be partially or fully molded using an injection molding process, or the like. Injection molding the carrier components allows the various components to be formed in a desired shape and configuration, and allows for the customization of the components and the carrier, if desired. Further, injection molding the shell components allows for custom finishes, better quality finishes, a simpler manufacturing process, the addition of features to improve performance (e.g., retention, durability, etc.), and reduced cost.

Techniques and devices are discussed with reference to example firearm magazine carriers illustrated in the figures. However, this is not intended to be limiting, and is for ease of discussion and illustrative convenience. The techniques and devices discussed may be applied to any of various cases, case designs, combinations, and the like, (e.g., enclosures, sheaths, covers, cases, carriers, etc.) for encasing tools, weapons, or other implements and accessories, and remain within the scope of the disclosure.

Implementations are explained in more detail below using a plurality of examples. Although various implementations and examples are discussed here and below, further implementations and examples may be possible by combining the features and elements of individual implementations and examples.

Example Modular Carrier

Referring to FIGS. 1 through 9, an example modular carrier 100 is shown in several non-limiting example configurations. In various embodiments, as shown in FIGS. 1-9, a first shell component 102 is combined with a second shell component 104, for example, to form the implement carrier 100 (as shown in FIG. 1, for instance), which comprises a wearable enclosure for carrying a tactical implement, an accessory, or the like. In an example, the enclosure comprises a wearable or attachable carrier for a firearm magazine with adjustable retention to accommodate varying sizes of magazines.

In an implementation, the first shell component 102 and the second shell component 104 comprise complementary cover portions or modular shell sections (half-shells or shell portions, for example). In an embodiment, the second shell component 104 is releasably coupled to the first shell component 102 in a modular fashion. In alternate embodiments, the first shell component 102 or the second shell component 104 may be combined with alternate shell components to form alternate enclosures (with different dimensions, capacity, features, attachments, etc.).

For example, one of a multiplicity of first shell components 102 may be coupled to the second shell component 104 (and vice versa) in a modular fashion, to carry one of a multiplicity of implements or accessories with the carrier 100. In one example, a user may remove a first shell component 102 from the second shell component 104 and replace it with a different first shell component 102, to use the carrier 100 for carrying a different implement. In such an example, the first 102 or second 104 shell component may be molded to the shape of a specific accessory or a range of accessories.

In an implementation, as shown in FIGS. 1-9, the first shell component 102 includes a first attachment member 106 and the second shell component 104 includes a second attachment member 108. In various embodiments, the first shell component 102 and the second shell component 104 may be pivotally and/or adjustably attached via the first attachment member 106 and the second attachment member 108 (using an adjustable retention component 114, for example) to form the carrier 100. Since the first 102 and second 104 shell components can pivot and/or adjust at the first 106 and second 108 attachment points, the depth (thickness) of the carrier 100 is adjustable to fit a variety of different sizes of accessories (such as different types of firearms magazines, for example).

In an embodiment, the carrier 100 includes an opening 107 to the interior of the carrier 100. For example, an accessory may be inserted into the enclosure through the opening 107. In one example, as shown in FIG. 1, the carrier 100 includes a contoured lip 109 providing facilitated access to the opening 107 and the interior of the carrier 100. In various embodiments, the lip 109 may have different shapes to accommodate different accessories to be carried. For instance, the lip 109 may improve the ease of quickly and securely inserting or removing an accessory (such as a firearm magazine, for example) to and from the carrier 100, by functioning as a guide during the insertion or removal of the accessory.

As also shown in FIGS. 1-9, the first shell component 102 includes at least one first retention member 110 and the second shell component 104 includes at least one second retention member 112. In an implementation, the modular carrier 100 includes at least one adjustable retention component 114 arranged to mechanically engage the first 110 and second 112 retention members to determine an interior volume of the enclosure and a retention force on the tactical implement or accessory. In an embodiment, the carrier 100 includes multiple adjustable retention components 114 arranged to mechanically engage first 110 and second 112 retention members (and in some examples first 106 and second 108 attachment members) to determine an interior volume of the enclosure and a retention force on the tactical implement or accessory.

For instance, the retention component 114 may screw into a threaded portion of the first 110 and/or second 112 retention members (and in some examples first 106 and second 108 attachment members) to determine a distance between the first 102 and second 104 shell components, thereby determining an interior volume of the carrier 100. In alternate embodiments, the retention component 114 may engage the first 110 and/or second 112 retention members, and/or the first 106 and/or second 108 attachment members in a different manner (e.g., snap engagement, friction fit, saw tooth, etc.) or differently from each other.

In an implementation, the retention component 114 engages the first 110 and second 112 retention members (and/or first 106 and second 108 attachment members) individually, and in both tension and compression directions. In one example (illustrated in FIGS. 7 and 8), the head of the retention component 114 may be trapped by a feature 702 (e.g., a notch, a cutout, a groove, an inset, etc.) of the first retention member 110 or the first attachment member 106, so that the retention component 114 maintains a position relative to the first shell component 102 while adjusting a distance of the first shell component 102 to the second shell component 104. As shown in FIG. 8, the head of the retention component 114 is placed into the feature 702, and then may be threaded, pressed, etc. into the second retention member 112 or second attachment member 108 to adjust a distance between the first 102 and second 104 shell components.

By engaging the first 110 and second 112 retention members and/or first 106 and second 108 attachment members individually, the carrier 100 is stable in shape and adjusted dimensions, and will not collapse when empty or expand when filled. Instead, the carrier 100 provides a desired retention to an accessory inserted within the carrier 100, which tension may be adjusted using the retention component 114 by a user. For example, multiple adjustable points (e.g., 110, 112, 106, 108) on each of the first 102 and second 104 shell components can be adjusted individually to define the positional relationship between the first 102 and second 104 shell components, including a distance and an angle between one or more edges of the first shell component 102 with respect to one or more associated edges of the second shell component 104 when the first 102 and second 104 shell components are attached. In various embodiments, a tool 704 (see FIG. 7) may be used to adjust the retention of the carrier 100. In alternate embodiments, the retention of the carrier 100 may be adjusted by hand.

In an implementation, as shown in FIGS. 2-4, and 6, the modular carrier 100 includes a clip 202 coupled to the first 102 or second 104 shell components, arranged to secure the enclosure (i.e., the carrier 100) to a garment of a user or an object in multiple configurations. In one implementation, the clip 202 is arranged to be attached to the enclosure (i.e., the carrier 100) at one or more of multiple locations (e.g., attachment points 116) on the enclosure to provide multiple carry options. For example, as shown in FIGS. 1 and 5, the user may choose from multiple attachment points 116 to attach the clip 202 to the carrier 100, so that the carrier 100 can be adjusted for ride position when worn or adjusted for desired positioning when attached to an object. In various embodiments, a carrier 100 may include any number of attachment points 116 at various locations on the carrier 100.

Figure 2:
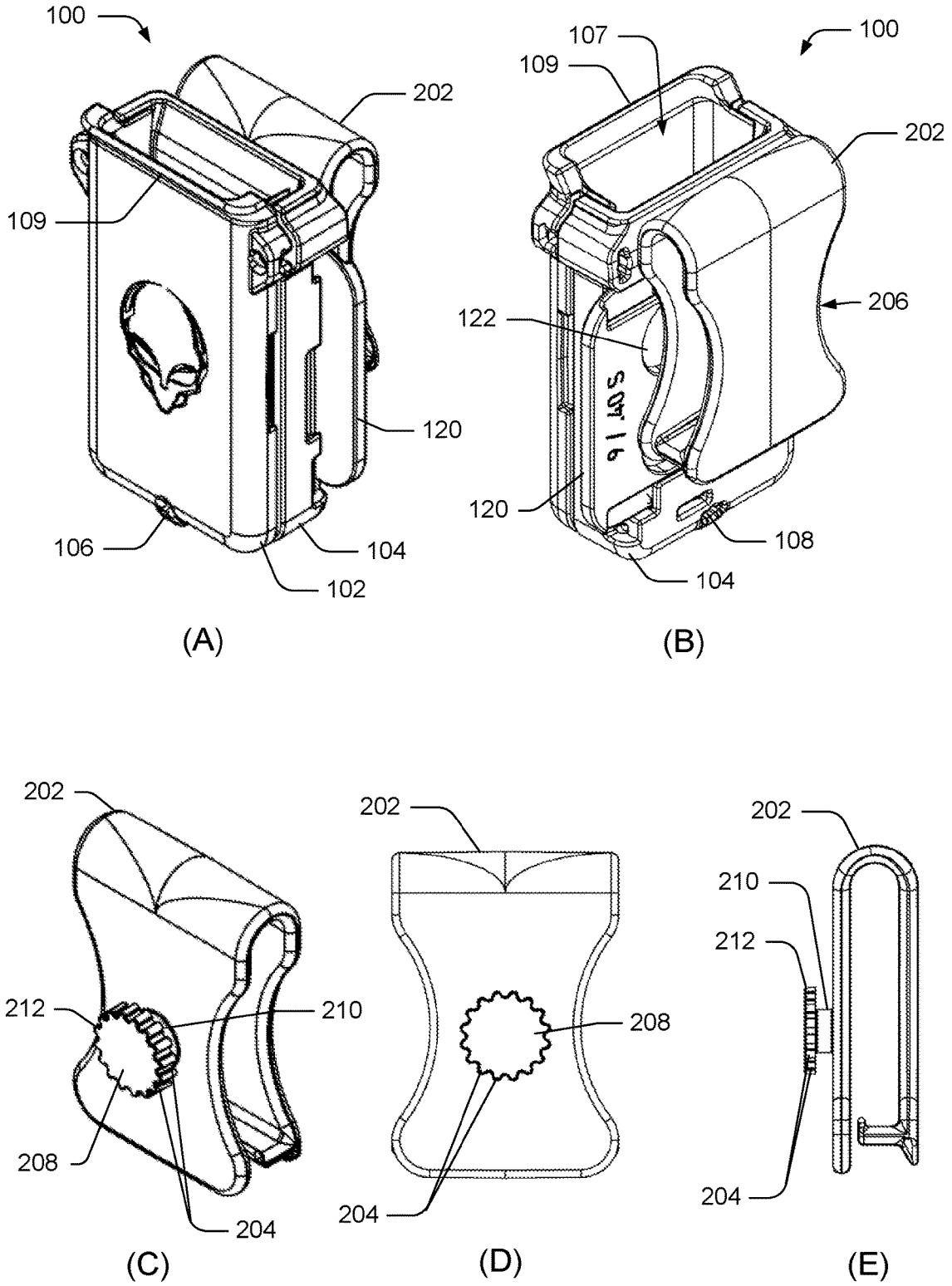
FIG. 2 includes two perspective views (at A and B) of the carrier assembly of FIG. 1, including a first example clip, according to an embodiment. Also included are three views (at C-E) of the first example clip.
Figure 3:
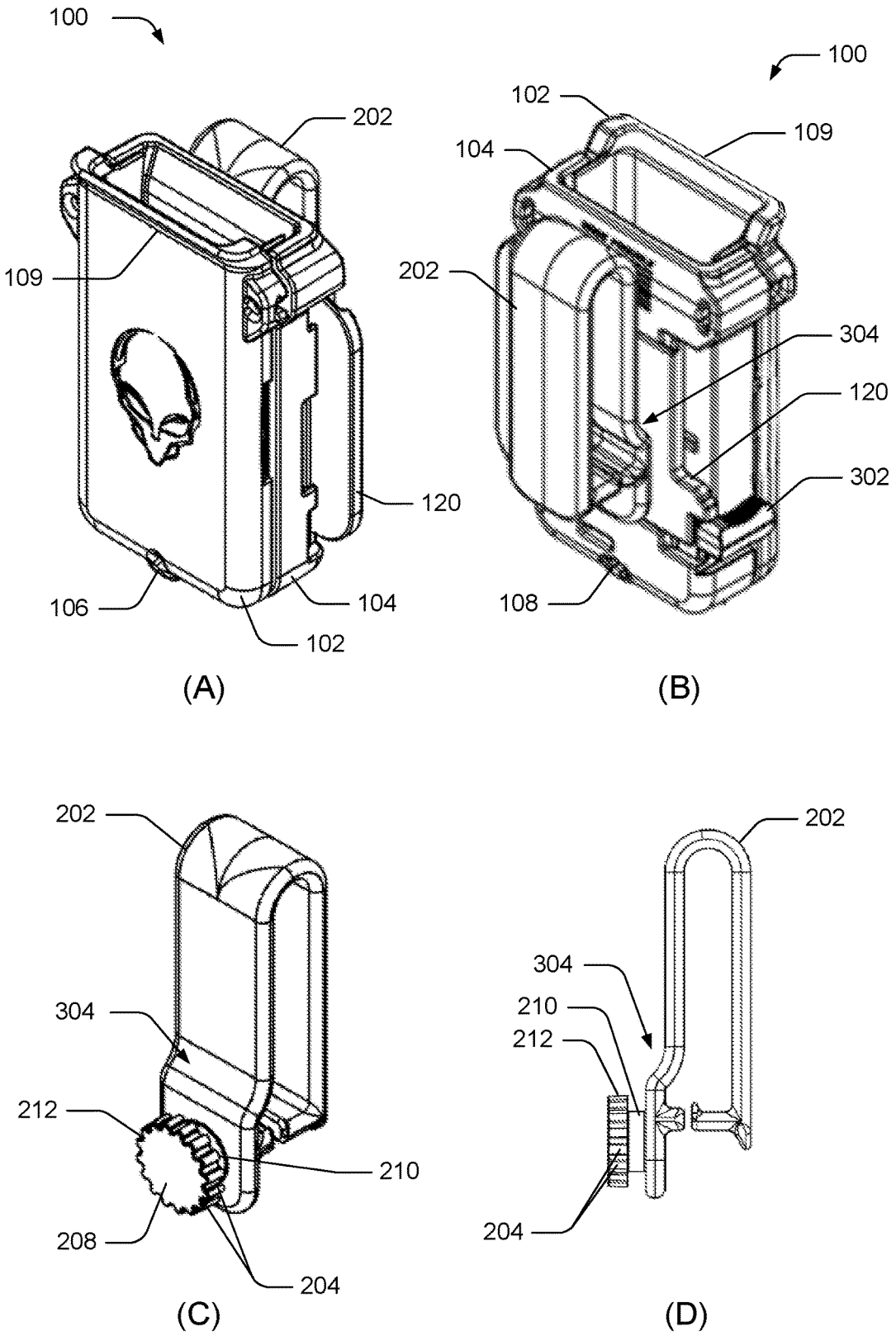
FIG. 3 includes two perspective views (at A and B) of the carrier assembly of FIG. 1, including a second example clip, according to an embodiment. Also included are two views (at C-D) of the second example clip.

As shown in FIGS. 2 and 3, different styles of clips 202 may be available for use with the carrier 100. A clip 202 such as the one shown in FIG. 2 may be used when the carrier 100 is to be worn in an outside the waistband (OWB) position, which could also be a factor in the user's choice of attachment points 116 (for example, a centrally located attachment point 116 may be selected). A clip 202 such as the one shown in FIG. 3 may be used when the carrier 100 is to be worn in an inside the waistband (IWB) position, which could also be a factor in the user's choice of attachment points 116 (for example, a relatively higher attachment point 116 may be selected). In an implementation, as shown in FIG. 3, the clip 202 includes an offset 304. In the implementation, the offset 304 of the clip 202 and the enclosure of the carrier 100 form a gap at the waistband of the user's garment (e.g., trousers) for a shirt to be tucked into, when wearing the carrier 100 IWB. The clips 202 illustrated in FIGS. 2 and 3 or other clips 202 (e.g., specialty clips 202 or universal clips 202 including J-clips, C-clips, keepers, straps, loops, or other devices) could be selected for use when it is desired to temporarily mount the carrier 100 to an object, a surface, or in a particular place.

In various embodiments, the clip 202 is removable from the carrier 100 and interchangeable. For example, the clip 202 may be interchanged with one of a plurality of clips 202 and connectors arranged for wearing the enclosure (i.e., carrier 100) in an inside-the-waistband (IWB) configuration, an outside-the-waistband (OWB) configuration, or for coupling the enclosure to an object. A user may interchange the clip 202 for another clip 202 or connector based on changing a preference to wear the enclosure in a different configuration, or to couple the enclosure to an object. In an alternate implementation, the clip 202 is integral to, or fixed to the first 102 or second 104 shell components. In such an implementation, a user may make adjustments to carry positions by adjusting a portion of the clip 202, for example.

In an embodiment, as discussed further below, the clip 202 may be adjustable to change a relative rotational position of the enclosure (i.e., the carrier 100) with respect to the clip 202, including forward, neutral, and reverse angular positions, as desired.

Figure 4:
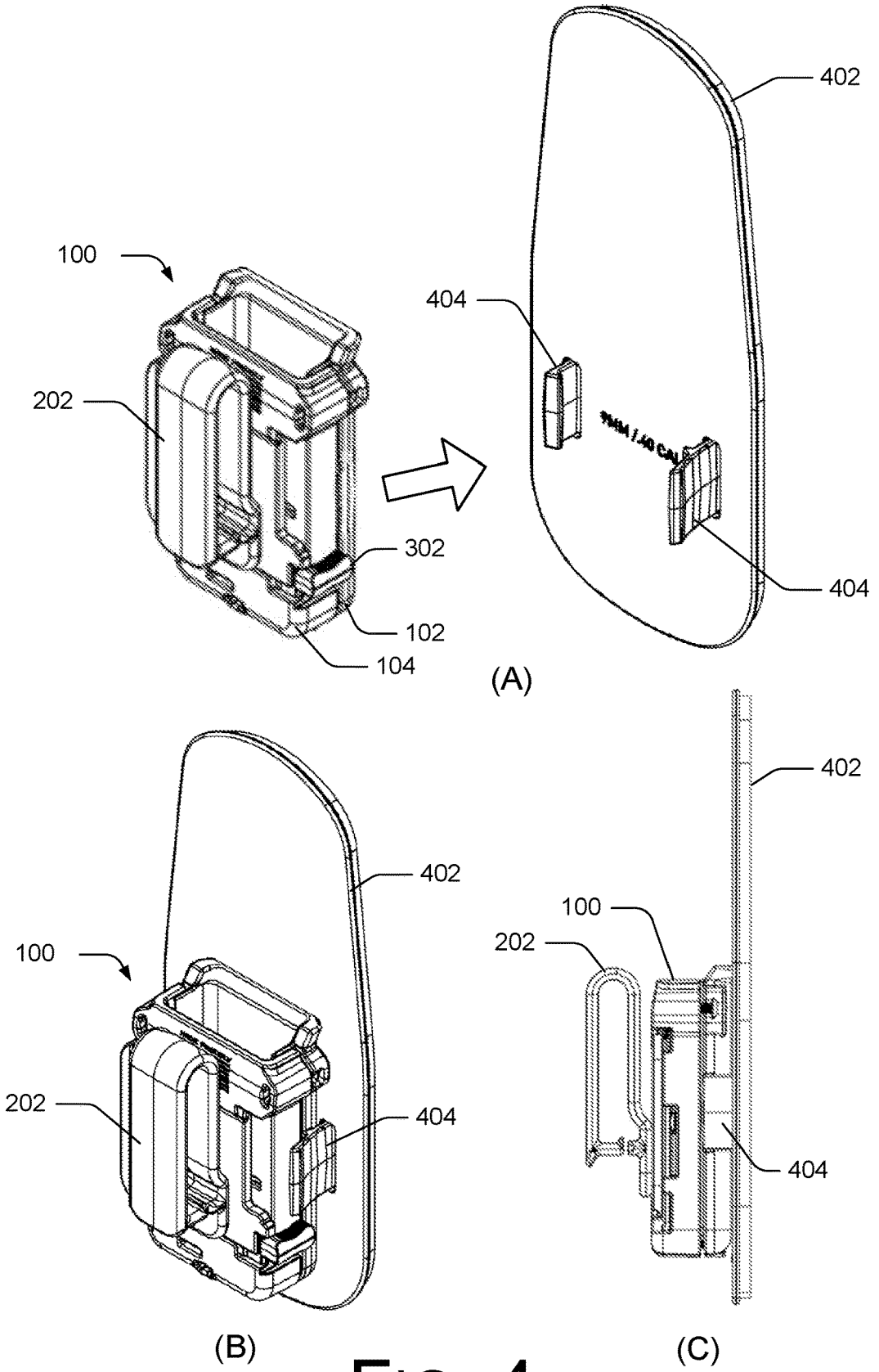
FIG. 4 includes a perspective view of an example backer being attached to a carrier (at A), and two views of the backer attached to the carrier (at B and C).
Figure 5:
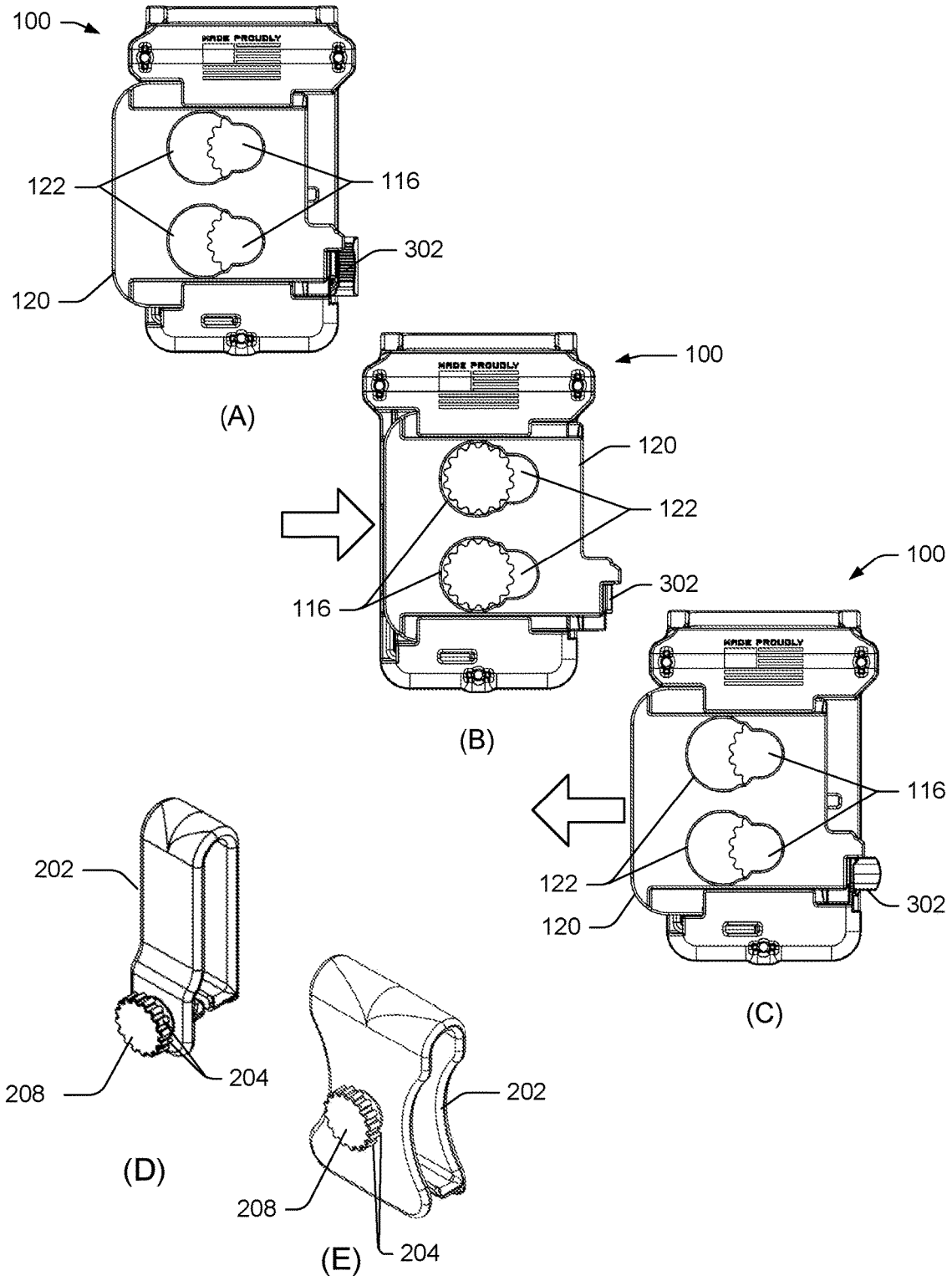
FIG. 5 includes three views (at A-C) showing the operation of an example locking plate, according to an implementation. Two example clips are also shown (at D and E).

In an implementation, as shown in FIG. 4, the modular carrier 100 includes a backer 402 removeably attached to the first shell component 102 via one or more backer fasteners 404. The backer 402 is arranged to provide a comfort barrier between the carrier 100 and the body of a user when the carrier 100 is worn by the user in an inside the waistband (IWB) configuration (for example, when a clip 202 is attached to the second shell component 104. Accordingly, the backer 402 may be easily coupled to the carrier 100 when desired, and easily removed when other carry options are used.

In various embodiments, the backer 402 may be comprised of one or more layers of durable and comfortable material. For instance, a more durable, semi-flexible layer of material, such as a plastic or leather, may be used nearest the carrier 100, while a resilient but comfortable layer of material, such as neoprene, for example, may be used next to the user's body. In various embodiments, the backer fasteners 404 may comprise metal or plastic clips, hook and loop fastener, or other engagement devices.

In an implementation, the modular carrier 100 includes a mounting assembly 206 comprising one or more recessed attachment points 116, and at least one interchangeable clip 202. In an embodiment, the mounting assembly also includes a locking mechanism, such as a locking plate 120. In an implementation, the mounting assembly 206 is arranged to provide a secure, adjustable, modular mounting system for mounting the carrier 100 to a user (via a garment, belt, strap, or accessory) or an object (a surface, furniture, vehicle, locker, etc.). In various examples, the mounting assembly 206 can provide for a wide range of mounting options and configurations, based on the modularity, adjustability, and interchangeability of the components.

In an embodiment, as shown in FIGS. 1 and 5, the one or more recessed attachment points 116 are arranged on a surface of the second shell component 104, and are arranged to provide one or more clip 202 mounting locations. For example, as shown in FIGS. 1 and 5, the user may choose from multiple recessed attachment points 116 to attach the clip 202 to the carrier 100, so that the carrier 100 can be adjusted for ride position when worn or adjusted for desired positioning when attached to an object. A clip 202 may be attached to one or more of the recessed attachment points 116 simultaneously for desired adjustability or stability. As shown in FIGS. 1 and 5, the recessed attachment points 116 may include a featured shape to adjust a relative position of the carrier 100 with respect to the clip 202.

Figure 6:
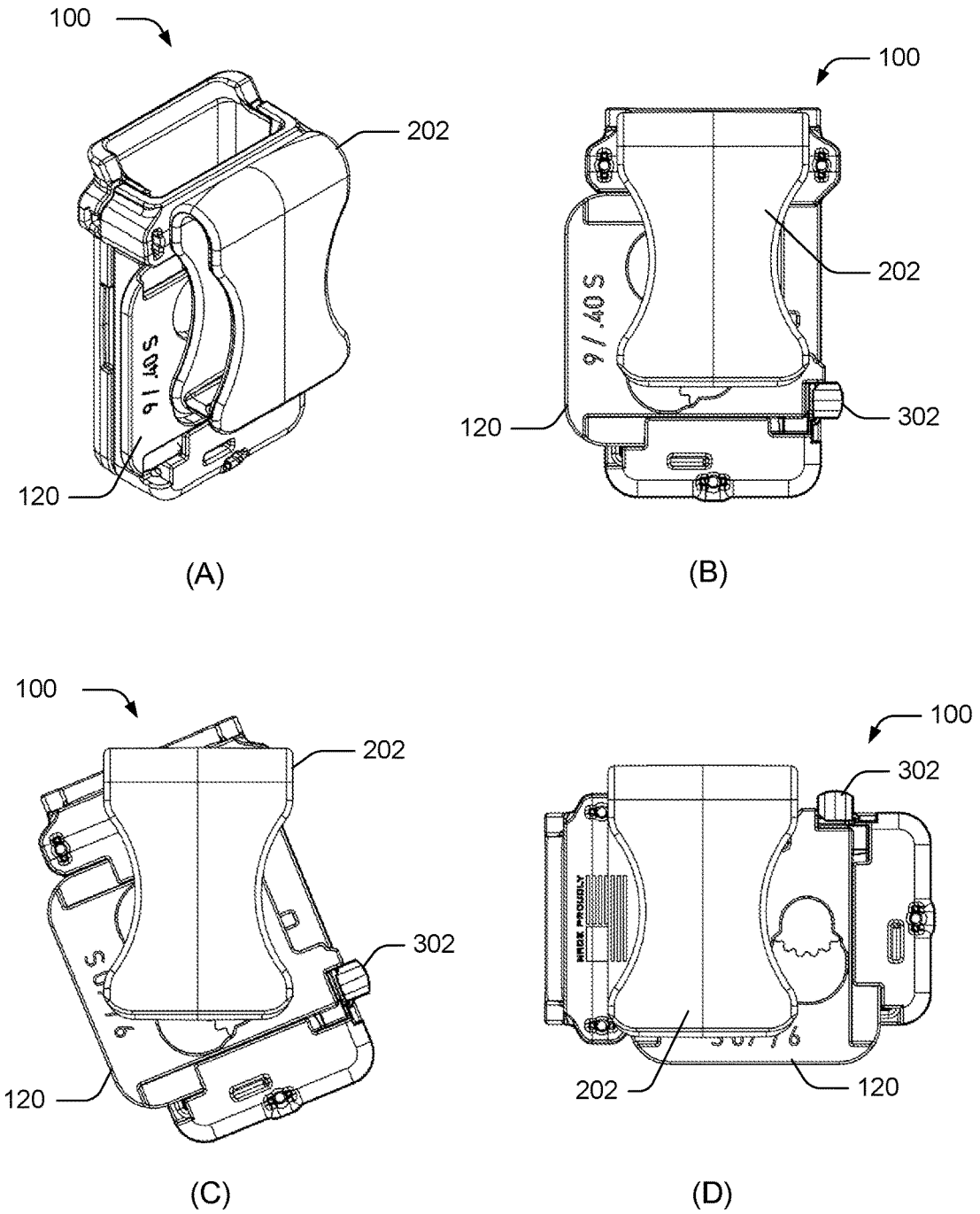
FIG. 6 includes four views (at A-D) showing various example rotational orientations of a clip relative to a carrier, according to an embodiment.

In various examples, a clip 202 includes a lug 208 comprising a shaft 210 and a head 212 to removeably attach the clip 202 to the second shell component 104. In the examples, the head 212 is shaped and sized to fit securely into the one or more recesses 116 on the surface of the second shell component 104. The one or more recesses 116 and the head 212 of the lug 208 have a matching or complementary featured shape arranged to cause the clip 202 to have one of a plurality of discrete rotational orientations relative to the carrier 100. In an example, as shown in FIG. 6, the carrier 100 may be positioned anywhere from 0 to 360 degrees relative to the clip 202, subject to the pitch of the features 204. The matching shape and secure fit of the head 212 of the lug 208 to the recess 116 prevents the clip 202 from rotating further relative to the carrier 100 when the head 212 of the lug 208 is securely inserted into the one or more recesses 116. In various examples, the featured shape of the one or more recesses 116 and the head 212 of the lug 208 includes a plurality of splines, teeth, edges, or the like, or any other shape (e.g., star, ovoid, polygon, irregular, etc.) to create one or more discrete relative rotational orientations between the clip 202 and the carrier 100.

In an implementation, as shown in FIGS. 1-3, 5, 8, and 9, a locking plate 120 is slideably coupled to the second shell component 104. In an example, the locking plate 120 includes one or more openings 122 to correspond to the one or more recesses 116 on the surface of the second shell component 104. The one or more openings 122 of the locking plate 120 align with the one or more recesses 116 when the locking plate is moved to the second (open) position, providing access to the one or more recesses 116. The locking plate 120 is arranged to prevent the head 212 of the lug 208 from being inserted into the one or more recesses 116 or from being removed from the one or more recesses 116 when the locking plate 120 is in a first (closed) position and to allow the head 212 of the lug 208 to be inserted into the one or more recesses 116 or removed from the one or more recesses 116 when the locking plate 120 is in the second (open) position.

As illustrated in FIG. 5, the locking plate 120 may be slideably moved from the first position (A) to the second position (B) and back to the first position (C) as desired by the user to insert, remove, or change a clip 202 on the carrier 100. In an embodiment, the locking plate 120 is held in the first (closed) position by a spring tension, or the like. In the embodiment, the user can move the locking plate 120 from the first position, causing the spring tension on the locking plate 120 to increase when the locking plate 120 is moved from the first position to the second position, the locking plate 120 returning to the first position when released. The locking plate 120 may be provided with a convenient surface, button, lever, or the like, for user-activation of the locking plate 120, in some examples.

In an implementation, as shown in FIGS. 1, 5, 8, and 9, the one or more openings 122 of the locking plate 120 have a "keyhole shape" arranged to allow the head 212 of the lug 208 to pass through the locking plate 120 when the locking plate 120 is in the second position and to prevent the head 212 of the lug 208 from passing through the locking plate 120 when the locking plate 120 is in the first position. With the interlocking keyhole shape of the openings 122, a portion of the locking plate 120 is arranged to overlay and trap a portion of the head 212 of the lug 208 when the head 212 of the lug 208 is inserted into the one or more recesses 116 and the locking plate 120 is in the first position. When the locking plate 120 is in the second position, the keyhole shape of the openings 122 allows the head 212 of the lug 208 to freely move through the locking plate 120.

In an implementation, as shown in FIGS. 3-9, the mounting assembly 206 includes a slide lock 302 moveably coupled to the first shell component 102 or the second shell component 104 and arranged to engage with a portion of the locking plate 120. The slide lock 302 is arranged to prevent the locking plate 120 from moving from the first position when the slide lock 302 is at rest and to allow the locking plate 120 to move from the first position when the slide lock 302 is activated.

Figure 8:
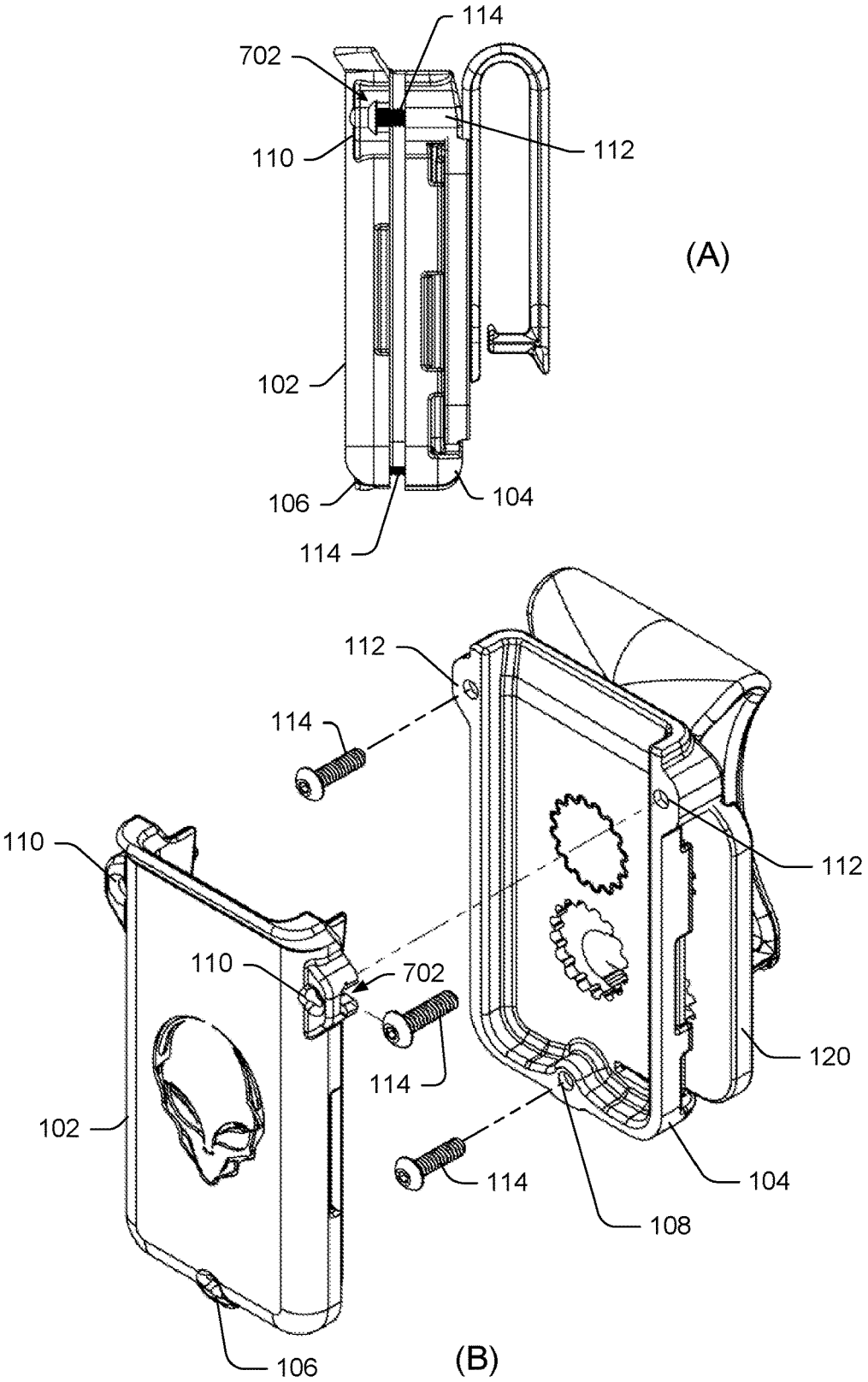
FIG. 8 shows an example assembly of the modular carrier assembly of FIG. 1 and example fastener locations (at A and B).
Figure 9:
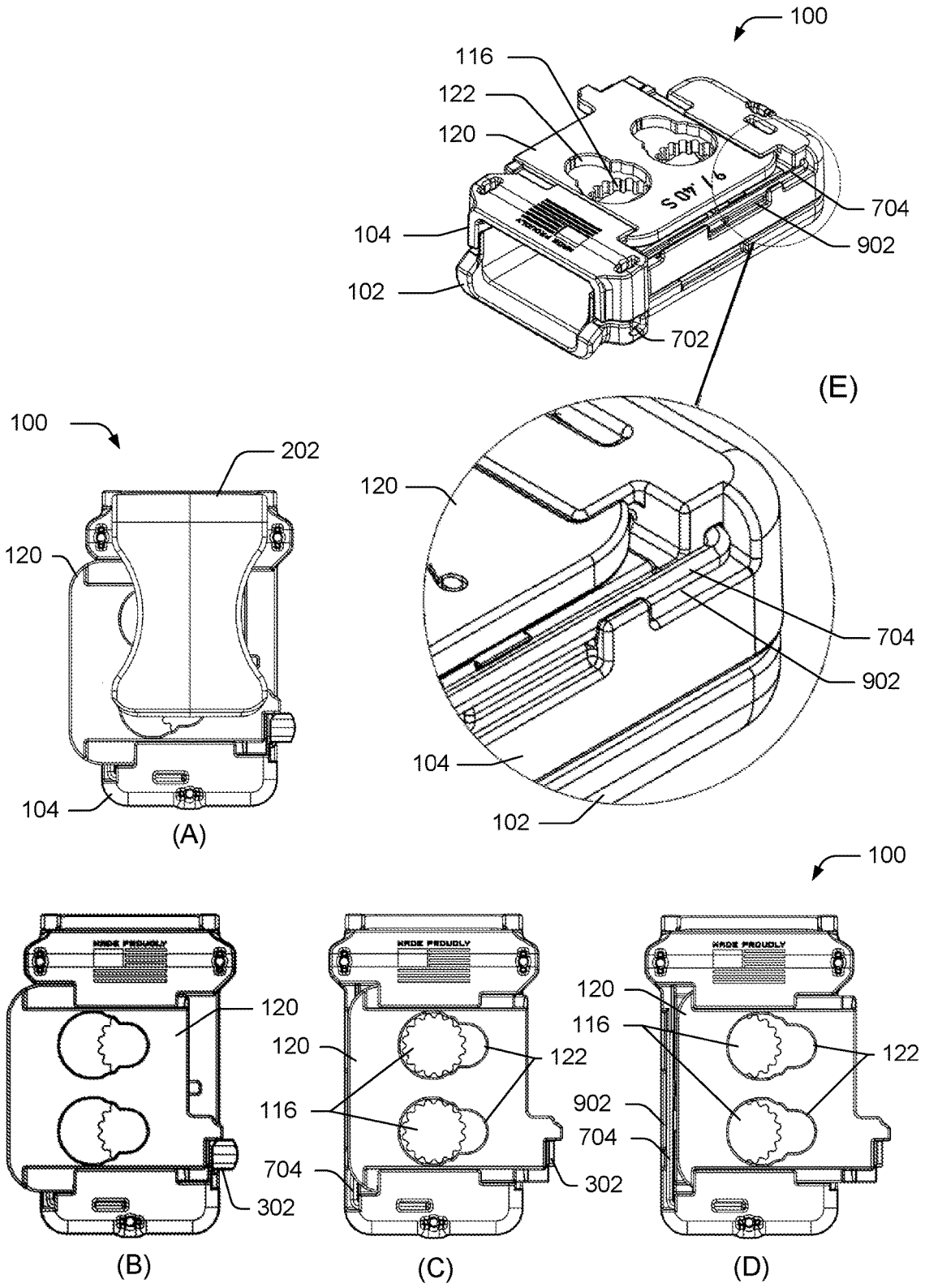
FIG. 9 includes four views showing an example of revealing a storage compartment of a carrier (at A-D), according to an implementation. A detail view of an adjustment tool stored within a storage compartment is also included (at E).

In various embodiments, the slide lock 302 may be activated in different ways. For example, the slide lock 302 may be rotated, as shown in FIGS. 5, 8 and 9. In the example, when the slide lock 302 is at rest, it is in a substantially perpendicular orientation with respect to the side edge of the second shell component 104. In the rest position, the slide lock engages a portion of the locking plate 120, while the locking plate 120 is in the first (closed) position, preventing the locking plate 120 from moving into the second position. Rotating the slide lock 302 approximately 90 degrees, so that the slide lock 302 is substantially parallel to the side edge of the second shell component 104 releases the slide lock 302 from engaging the locking plate 120, and allows the locking plate 120 to move into the second (open) position. Once the locking plate 120 is moved back into the first position, the slide lock 302 may be rotated approximately 90 degrees to its rest position, where the slide lock 302 engages a portion of the locking plate 120 again.

In alternate embodiments, the slide lock 302 may be activated by sliding the slide lock 302 from a first position to a second position. For instance, the slide lock 302 could be slid from side-to-side (towards the first 102 or second 104 shell components) to release or to lock the locking plate 120. Or else, the slide lock 302 could be slid down (towards the bottom of the carrier 100) or up (towards the opening of the carrier 100) to release or lock the locking plate 120, for example. Reversing the motion can put the slide lock 302 in the rest position. In other embodiments, other slide lock 302 actions are also possible.

Figure 7:
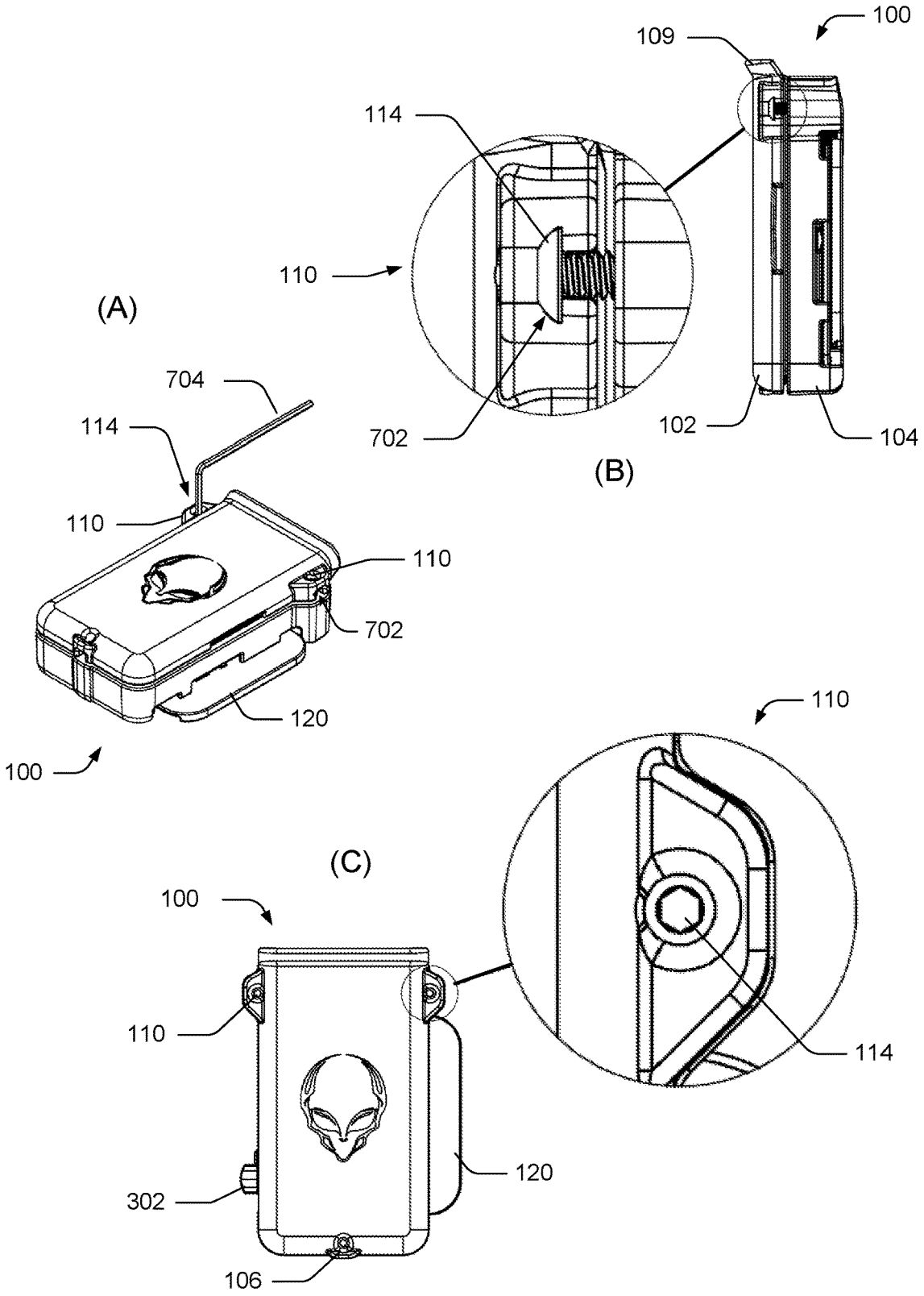
FIG. 7 shows an example of retention adjustment of a carrier (at A), according to an embodiment, and two detail views (at B and C) of example retention adjustment components.

In some implementations, as shown in FIG. 7, the adjustable retention component(s) 114 may be adjusted using a tool 704, such as a hex wrench, screwdriver, socket driver, or other like tools. As shown in FIG. 8, the carrier 100 may include multiple attachment points (110, 112, 106, 108), where one or more (or all) of the attachment points (110, 112, 106, 108) are adjustable via the adjustable retention component(s) 114, for example, to adjust a retention of the carrier 100. For instance, adjusting each of the attachment points (110, 112, 106, 108) defines the geometric relationship between the first 102 and second 104 shell components. The first 102 and second 104 shell components can be parallel if the adjusted spacing of all attachment points is equal, a symmetric wedge if the spacing of multiple sets of attachment points 110 and 112 is equal and the spacing between attachment members 106 and 108 is different, or the relationship can be asymmetric if all attachment points (110, 112, 106, 108) are adjusted to different lengths.

In one implementation, as shown in FIG. 9, the modular carrier 100 includes a storage compartment 902, which may be used for storing a removable retention adjustment tool 704. In an example, the storage compartment 902 may be partially or fully concealed by a portion of the carrier 100.

In an embodiment, as shown in FIG. 9, the storage compartment 902 is concealed by a portion of the locking plate 120. In the embodiment, the locking plate 120 functions as a cover for the compartment 902. For example, as shown in FIG. 9, the storage compartment 902 may be accessed by moving the locking plate 120. As shown at (A), the clip 202 may be moved or removed if the clip 202 obstructs access to the compartment 902. As shown at (B), the locking plate 120 is moved from the first (closed) position by activating the slide lock 302, if present. As shown at (C), the locking plate 120 is moved at least to a second (open) position, where the openings 122 of the locking plate 120 are aligned with the recesses 116. As shown at (D), the locking plate 120 is moved past the second position to a third position that allows access to the compartment 902.

With access gained to the storage compartment 902, the tool 704 may be removed or replaced within the compartment 902. In an embodiment, the tool is secured within the compartment 902, by friction fit, or the like, so as not to rattle around when stowed. When the user is finished with the compartment 902, the locking plate 120 may be moved back to the first position. If the locking plate 120 is spring-loaded, releasing the locking plate 120 will allow it to return to the first position due to the spring tension. Once the locking plate 120 is in the first position, the slide lock 302 may be moved to a rest position, engaging and locking the locking plate 120 in place.

In an implementation, one or more components of the carrier 100, including the first shell component 102 and/or the second shell component 104 are partially or fully formed using an injection molding process. Accordingly, the first shell component 102 and/or the second shell component 104 (and thus the carrier 100) can be custom molded as desired for the user and/or as needed for carrying a tactical implement or accessory, for instance. In another implementation, one or more of the clips 202 and/or one or more components of the mounting assembly 206 are partially or fully formed using an injection molding process. In alternate implementations, one or more components of the carrier 100 (including the mounting assembly 206) are formed by some other process (e.g., stamping, cutting, etc.).

Some materials that may be used to form one or more carrier 100 components include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, combinations of the same, and the like.

As discussed above, the techniques, components, and devices described herein with respect to the implementations are not limited to the illustrations of FIGS. 1-8, and may be applied to other carrier devices, and case designs, without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a first shell component 102 and a second shell component 104 combination may be implemented as a stand-alone device or as part of another system (e.g., integrated with other components to form a carrier 100, as described above). In various implementations, additional or alternative components may be used to accomplish the disclosed techniques and arrangements.

Representative Process

Figure 10:
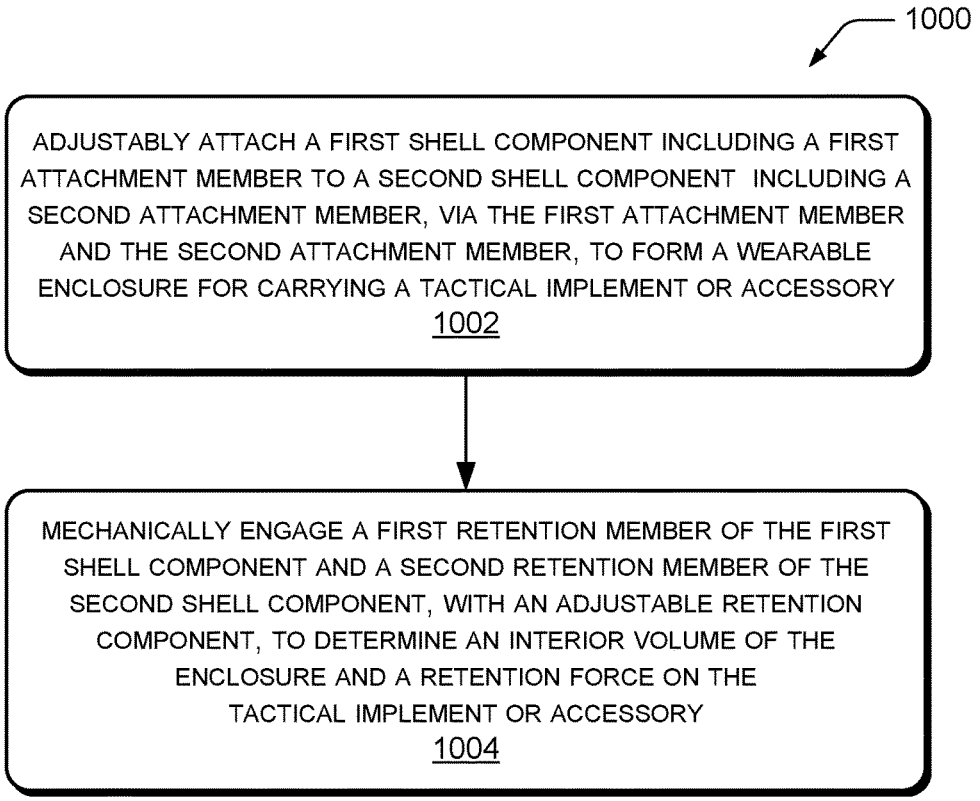
FIG. 10 illustrates a flow diagram of an example method of preparing a modular carrier, according to an implementation.

FIG. 10 is a flow diagram illustrating an example method 1000 for forming a modular carrier (such as carrier 100, for example), according to various implementations. The process 1000 is described with reference to FIGS. 1-9.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 1002, the process includes pivotally and/or adjustably attaching a first shell component (such as first shell component 102, for example) including a first attachment member (such as first attachment member 106, for example) to a second shell component (such as second shell component 104, for example) including a second attachment member (such as second attachment member 108, for example), via the first attachment member and the second attachment member, to form a wearable enclosure (such as the carrier 100, for example) for carrying a tactical implement or accessory. In an implementation, the process includes increasing or decreasing a retention of the carrier based on an angle formed between the first and second shell components and the first and second attachment components.

At block 1004, the process includes mechanically engaging a first retention member (such as first retention member 110, for example) of the first shell component and a second retention member (such as second retention member 112, for example) of the second shell component, with an adjustable retention component (such as retention component 114, for example), to determine an interior volume of the enclosure and a retention force on the tactical implement or accessory. In an implementation, the process includes increasing or decreasing a retention of the enclosure by adjusting a relative position of the first shell component to the second shell component, based on an individual adjustment of each of a plurality of adjustable retention components, including a distance and an angle between one or more edges of the first shell component with respect to one or more associated edges of the second shell component when the first and second shell components are attached.

In an implementation, the process includes adjusting the interior volume and retention of the enclosure to fit one of a plurality of firearm magazines via the adjustable retention component and inserting the firearm magazine into the enclosure for carrying the magazine. In an implementation, the process includes retaining the magazine within the carrier based in part on adjusting the retention component.

In various embodiments, the process includes providing a plurality of first or second interchangeable shell components to form a variety of desired carriers with a variety of dimensions. For example, a first shell component may be removed from a second shell component, and one of a plurality of other first shell components may be coupled to the second shell component to form a similar carrier with one or more different dimensions.

In an implementation, the process includes coupling an interchangeable clip (such as clip 202, for example) to one of multiple attachment locations of the first or second shell component. The interchangeable clip is arranged to secure the enclosure to a garment of a user or an object, in multiple configurations. In an embodiment, the process includes adjusting a relative rotational position of the clip with respect to the enclosure, and securing the clip in the rotational position using a locking mechanism, or the like. In an embodiment, the process includes interchanging the clip with one of a plurality of clips and connectors arranged for wearing the enclosure in an inside-the-waistband (IWB) configuration, an outside-the-waistband (OWB) configuration, or for coupling the enclosure to an object, based on changing a preference to wear the enclosure in an inside-the-waistband (IWB) configuration, an outside-the-waistband (OWB) configuration, or to couple the enclosure to an object, respectively.

In an implementation, the process includes removeably coupling an interchangeable clip (such as clip 202, for example) to the second shell component using one or more recesses (such as recesses 116, for example) arranged on a surface of the second shell component. In one implementation, the process includes: moving a locking plate (such as locking plate 120, for example) slideably coupled to the second shell component from a first position that prevents access to the one or more recesses to a second position to provide access to the one or more recesses; inserting a lug (such as lug 208, for example) of the clip into a recess of the one or more recesses, the lug comprising a shaft and a head (such as head 212, for example), where the head is shaped and sized to fit securely into the recess; and moving the locking plate from the second position to the first position, preventing the head of the lug from being removed from the recess.

In an implementation, the process includes positioning the clip in one of a plurality of discrete rotational orientations relative to the enclosure by inserting the head of the lug into the recess. In the implementation, the recess and the head of the lug each have a featured shape (such as features 204, for example), where the featured shape prevents the clip from rotating relative to the enclosure when the head of the lug is inserted into the recess.

In an implementation, the process includes moving the locking plate from the first position to the second position to allow the head of the lug to pass through an opening (such as opening 122, for example) in the locking plate and moving the locking plate from the first position to the second position to overlay and trap a portion of the head of the lug with a portion of the locking plate while the head of the lug is inserted into one of the one or more recesses. In various embodiments, the locking plate may include a featured portion (like a press-button, for instance) for activating the locking plate by a user.

In an implementation, the process includes moving a slide lock (such as slide lock 302, for example) moveably coupled to the first shell component or the second shell component from a rest position to an activated position to move the locking plate from the first position to the second position. In the implementation, the process includes moving the slide lock from the activated position to the rest position to engage a portion of the locking plate and to prevent the locking plate from moving from the first position to the second position.

In an implementation, the process includes moving the locking plate from the first position to the second position, and removing the head of the lug from the recess to detach the interchangeable clip from the enclosure.

In an implementation, the process includes moving the locking plate from the first position or the second position to a third position, revealing a storage compartment of the enclosure having the locking plate as a cover.

In another implementation, the process includes removeably attaching a semi-flexible backer (such as backer 402, for example) to the first shell component via one or more backer fasteners. In an example, the backer is arranged to provide a comfort barrier between the enclosure and a body of a user when the enclosure is worn by the user in an inside the waistband (IWB) configuration.

In an implementation, the process includes forming the first or second shell components, one or more clips, and/or locking plate via plastic injection molding. In one example, the process includes tuning a flexibility, a rigidity, and a stability of the first or second shell components, one or more clips, and/or locking plate based on selecting a plastic material and a thickness of the first or second shell components, one or more clips, and/or locking plate.

In alternate implementations, other techniques may be included in the process 1000 in various combinations, and remain within the scope of the disclosure.

Conclusion

While various discreet embodiments have been described throughout, the individual features of the various embodiments may be combined to form other embodiments not specifically described. The embodiments formed by combining the features of described embodiments are also within the scope of the disclosure.

What is claimed is:

1. An apparatus, comprising:

a first shell component comprising a first retention member and a first attachment member;

a second shell component comprising a second retention member and a second attachment member, the first shell component and the second shell component adjustably attachable via the first attachment member and the second attachment member to form a wearable enclosure for carrying a tactical implement or accessory; and an adjustable retention component arranged to mechanically engage the first and second retention members to determine an interior volume of the enclosure and a retention force on the tactical implement or accessory, wherein the enclosure comprises a wearable or attachable carrier for a firearm magazine with adjustable retention to accommodate varying sizes of magazines.

2. The apparatus of claim 1, further comprising a mounting assembly, comprising:

one or more recesses arranged on a surface of the second shell component, the one or more recesses arranged to provide one or more clip mounting locations; and an interchangeable clip arranged to secure the enclosure to an object in multiple configurations, the clip including a lug comprising a shaft and a head to removeably attach the clip to the second shell component, the head shaped and sized to fit securely into the one or more recesses on the surface of the second shell component.

3. The apparatus of claim 2, further comprising a locking plate slideably coupled to the second shell component, the locking plate including one or more openings to correspond to the one or more recesses on the surface of the second shell component, the locking plate arranged to prevent the head of the lug from being inserted into the one or more recesses or from being removed from the one or more recesses when the locking plate is in a first position and to allow the head of the lug to be inserted into the one or more recesses or removed from the one or more recesses when the locking plate is in a second position.

4. The apparatus of claim 3, further comprising a slide lock moveably coupled to the first shell component or the second shell component and arranged to engage with a portion of the locking plate, the slide lock arranged to prevent the locking plate from moving from the first position when the slide lock is at rest and to allow the locking plate to move from the first position when the slide lock is activated.

5. The apparatus of claim 3, wherein the one or more openings of the locking plate have a keyhole shape arranged to allow the head of the lug to pass through the locking plate when the locking plate is in the second position and to prevent the head of the lug from passing through the locking plate when the locking plate is in the first position, a portion of the locking plate arranged to overlay and trap a portion of the head of the lug when the head of the lug is inserted into the one or more recesses and the locking plate is in the first position.

6. The apparatus of claim 2, wherein the one or more recesses and the head of the lug have a featured shape arranged to cause the clip to have one of a plurality of discrete rotational orientations relative to the enclosure and to prevent the clip from rotating relative to the enclosure when the head of the lug is inserted into the one or more recesses.

7. The apparatus of claim 6, wherein the featured shape of the one or more recesses and the head of the lug includes a plurality of splines or teeth.

8. The apparatus of claim 1, further comprising a clip coupled to the first or second shell components, and arranged to secure the enclosure to a garment of a user or an object in multiple configurations, wherein the clip is adjustable to change a relative position of the enclosure with respect to the clip, including forward, neutral, and reverse angular positions.

9. The apparatus of claim 1, further comprising a clip coupled to the first or second shell components, and arranged to secure the enclosure to a garment of a user or an object in multiple configurations, wherein the clip is arranged to be attached to the enclosure at one or more of multiple attachment locations on the enclosure to provide multiple carry options.

10. The apparatus of claim 1, further comprising a clip coupled to the first or second shell components, and arranged to secure the enclosure to a garment of a user in an inside-the-waistband (IWB) configuration, wherein the clip includes an offset, the offset of the clip and the enclosure forming a gap at a waistband of the garment, arranged for a shirt to be tucked into.

11. The apparatus of claim 1, further comprising a backer removeably attached to the first shell component via one or more backer fasteners, the backer arranged to provide a comfort barrier between the enclosure and a body of a user when the enclosure is worn by the user in an inside the waistband (IWB) configuration.

12. The apparatus of claim 1, further comprising a removable retention adjustment tool stowed within a storage compartment of the enclosure.

13. The apparatus of claim 1, further comprising a plurality of adjustable retention components, wherein the plurality of adjustable retention components is arranged to determine a relative position of the first shell component to the second shell component based on an individual adjustment of each of the adjustable retention components, including a distance and an angle between one or more edges of the first shell component with respect to one or more associated edges of the second shell component when the first and second shell components are attached.

14. A carrier, comprising:

an enclosure for a firearm magazine, with adjustable retention components arranged to determine an interior volume of the enclosure and a retention force on the firearm magazine, the enclosure comprising:

a first shell component comprising a first retention member and a first attachment member;

a second shell component comprising a second retention member and a second attachment member, the first shell component and the second shell component adjustably attachable via the first attachment member and the second attachment member to form the enclosure; and an adjustable retention component arranged to mechanically engage the first and second retention members to determine the interior volume of the enclosure and the retention force on the firearm magazine; and a backer removeably coupled to the enclosure via one or more backer fasteners, the backer arranged to provide a comfort barrier between the enclosure and a body of a user when the enclosure is worn by the user in an inside-the-waistband (IWB) configuration.

15. A carrier, comprising:

an enclosure for a firearm magazine, with adjustable retention components arranged to determine an interior volume of the enclosure and a retention force on the firearm magazine, the enclosure comprising;

a first shell component comprising a first retention member and a first attachment member;

a second shell component comprising a second retention member and a second attachment member, the first shell component and the second shell component adjustably attachable via the first attachment member and the second attachment member to form the enclosure; and an adjustable retention component arranged to engage the first retention member at a predetermined position of the first retention member and to adjustably engage the second retention member at variable positions of the adjustable retention component and the second retention member to determine an interior volume of the enclosure and a retention force on the firearm magazine.

16. A method, comprising:

providing a first shell component comprising a first retention member and a first attachment member;

providing a second shell component comprising a second retention member and a second attachment member;

providing an adjustable retention component arranged to mechanically engage the first and second retention members;

adjustably attaching the first shell component including the first attachment member to the second shell component including the second attachment member, via the first attachment member and the second attachment member, to form a wearable enclosure for carrying a tactical implement or accessory, the enclosure comprising a carrier for a firearm magazine with adjustable retention to accommodate varying sizes of magazines; and mechanically engaging the first retention member of the first shell component and the second retention member of the second shell component, with the adjustable retention component, to determine an interior volume of the enclosure and a retention force on the tactical implement or accessory.

17. The method of claim 16, further comprising adjusting the interior volume and retention of the enclosure to fit one of a plurality of firearm magazines via the adjustable retention component and inserting the firearm magazine into the enclosure for carrying the magazine.

18. The method of claim 16, further comprising coupling an interchangeable clip to one or more of multiple attachment locations of the first shell component or the second shell component, the interchangeable clip arranged to secure the enclosure to a garment of a user or an object, in multiple configurations.

19. The method of claim 18, further comprising adjusting a relative rotational position of the clip with respect to the enclosure, and securing the clip in the rotational position using a locking mechanism.

20. The method of claim 18, further comprising interchanging the clip with one of a plurality of clips and connectors arranged for wearing the enclosure in an inside-the-waistband (IWB) configuration, an outside-the-waistband (OWB) configuration, or for coupling the enclosure to an object, based on changing a preference to wear the enclosure in an inside-the-waistband (IWB) configuration, an outside-the-waistband (OWB) configuration, or to couple the enclosure to an object, respectively.

21. The method of claim 18, further comprising removeably attaching a backer to the first shell component or the second shell component via one or more backer fasteners, the backer arranged to provide a comfort barrier between the enclosure and a body of a user when the enclosure is worn by the user in an inside the waistband (IWB) configuration.

22. The method of claim 16, further comprising removeably coupling an interchangeable clip to the second shell component, the clip arranged to secure the enclosure to an object in multiple configurations, the second shell component having one or more recesses arranged to provide one or more clip mounting locations, including:

moving a locking plate slideably coupled to the second shell component from a first position that prevents access to the one or more recesses to a second position to provide access to the one or more recesses;

inserting a lug of the clip into a recess of the one or more recesses, the lug comprising a shaft and a head and the head shaped and sized to fit securely into the recess;

moving the locking plate from the second position to the first position, preventing the head of the lug from being removed from the recess.

23. The method of claim 22, further comprising moving the locking plate from the first position to the second position to allow the head of the lug to pass through an opening in the locking plate and moving the locking plate from the first position to the second position to overlay and trap a portion of the head of the lug with a portion of the locking plate while the head of the lug is inserted into one of the one or more recesses.

24. The method of claim 22, further comprising positioning the clip in one of a plurality of discrete rotational orientations relative to the enclosure by inserting the head of the lug into the recess, based on the recess and the head of the lug each having a featured shape, the featured shape preventing the clip from rotating relative to the enclosure when the head of the lug is inserted into the recess.

25. The method of claim 22, further comprising moving the locking plate from the first position or the second position to a third position, revealing a portion of the enclosure beneath the locking plate.

26. The method of claim 22, further comprising moving a slide lock moveably coupled to the first shell component or the second shell component from a rest position to an activated position to move the locking plate from the first position to the second position and moving the slide lock from the activated position to the rest position to engage a portion of the locking plate and prevent the locking plate from moving from the first position to the second position.

27. The method of claim 22, further comprising moving the locking plate from the first position to the second position, and removing the head of the lug from the recess to detach the interchangeable clip from the enclosure.

* * * * *